US008269125B2

(12) United States Patent
Roth et al.

(10) Patent No.: US 8,269,125 B2
(45) Date of Patent: Sep. 18, 2012

(54) MIXED PRODUCT DELIVERY POINT SEQUENCER AND METHOD OF USE

(75) Inventors: J. Edward Roth, Lansdale, PA (US); David J. Coffelt, Owego, NY (US); Bruce H. Hanson, Endicott, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 1778 days.

(21) Appl. No.: 11/142,233

(22) Filed: Jun. 2, 2005

(65) Prior Publication Data

US 2006/0283784 A1 Dec. 21, 2006

(51) Int. Cl.
*G06K 9/00* (2006.01)

(52) U.S. Cl. ..... 209/584; 209/583; 209/900

(58) Field of Classification Search ..... 209/583, 209/584, 900; 700/223–227
See application file for complete search history.

(56) References Cited

U.S. PATENT DOCUMENTS

| | | | | |
|---|---|---|---|---|
| 3,650,278 | A * | 3/1972 | Cook | 131/215.3 |
| 3,757,939 | A * | 9/1973 | Henig | 209/584 |
| 3,880,298 | A | 4/1975 | Habegger et al. | |
| 3,929,076 | A | 12/1975 | McRae, Jr. et al. | |
| 3,941,372 | A | 3/1976 | Matsuo | |
| 3,966,186 | A * | 6/1976 | Helm | 270/52.02 |
| 4,181,947 | A | 1/1980 | Krauss et al. | |
| 4,401,301 | A | 8/1983 | Hayskar | |
| 4,440,492 | A | 4/1984 | Howard | |
| 4,566,595 | A | 1/1986 | Fustier | |
| 4,630,216 | A | 12/1986 | Tyler et al. | |
| 4,641,753 | A | 2/1987 | Tamada | |
| 4,672,553 | A | 6/1987 | Goldberg | |
| 4,690,751 | A | 9/1987 | Umiker | |
| 4,974,721 | A | 12/1990 | Born | |
| 5,009,321 | A | 4/1991 | Keough | |
| 5,031,223 | A | 7/1991 | Rosenbaum et al. | |
| 5,072,822 | A | 12/1991 | Smith | |
| 5,074,539 | A | 12/1991 | Wells et al. | |
| 5,133,543 | A | 7/1992 | Eitel et al. | |
| 5,226,547 | A | 7/1993 | Malatesta | |
| 5,287,271 | A | 2/1994 | Rosenbaum | |
| 5,287,976 | A | 2/1994 | Mayer et al. | |
| 5,289,983 | A | 3/1994 | Ueda et al. | |

(Continued)

FOREIGN PATENT DOCUMENTS

| | | |
|---|---|---|
| EP | 0575109 | 12/1993 |

(Continued)

*Primary Examiner* — Joseph C Rodriguez
*Assistant Examiner* — Kalyanavenkateshware Kumar
(74) *Attorney, Agent, or Firm* — Marcus P. Efthimiou; Andrew M. Calderon; Roberts Mlotkowski Safran & Cole, P.C.

(57) ABSTRACT

A device and method for device for sequencing disparate products includes at least a first feeder mechanism feeding a stream of a first product type in a pre-sequenced order. At least a second feeder mechanism feeds a stream of second product type though a sequencing process. A reading device reads product information of the first product type and the second product type. A pausing device pauses the first stream of the first product type or the second stream of the second product type in a first pass sort order of the sequencing process based on the information read from the reading device. The first product type and the second product type are intermixed into a stream forming a merged stream of sequenced first and second product type. A separation item may be placed between groupings of the intermixed product.

20 Claims, 5 Drawing Sheets

U.S. PATENT DOCUMENTS

| | | | | |
|---|---|---|---|---|
| 5,353,915 | A | 10/1994 | Schneider | |
| 5,398,922 | A | 3/1995 | Malatesta | |
| 5,415,518 | A | 5/1995 | Montgomery | |
| 5,419,440 | A | 5/1995 | Picoult | |
| 5,446,667 | A | 8/1995 | Oh et al. | |
| 5,544,758 | A | 8/1996 | Malatesta | |
| 5,706,928 | A | 1/1998 | Neukam | |
| 5,841,658 | A | 11/1998 | Bouchard | |
| 6,059,091 | A | 5/2000 | Maier et al. | |
| 6,239,397 | B1 | 5/2001 | Rosenbaum et al. | |
| 6,241,099 | B1 | 6/2001 | Hendrickson et al. | |
| 6,270,069 | B1 | 8/2001 | Cera et al. | |
| 6,303,889 | B1 * | 10/2001 | Hayduchok et al. | 209/584 |
| 6,328,302 | B2 | 12/2001 | Hendrickson et al. | |
| 6,443,311 | B2 | 9/2002 | Hendrickson et al. | |
| 6,501,041 | B1 * | 12/2002 | Burns et al. | 209/584 |
| 6,659,263 | B2 | 12/2003 | Hendrickson et al. | |
| 6,685,030 | B1 | 2/2004 | Mileaf | |
| 6,946,612 | B2 | 9/2005 | Morikawa | |
| 7,282,658 | B2 * | 10/2007 | Hanson et al. | 209/584 |
| 2001/0009233 | A1 | 7/2001 | Hendrickson et al. | |
| 2001/0050247 | A1 | 12/2001 | Myer, Sr. | |
| 2002/0074268 | A1 | 6/2002 | Hendrickson et al. | |
| 2004/0007510 | A1 * | 1/2004 | Kechel | 209/584 |
| 2006/0180519 | A1 * | 8/2006 | Carey et al. | 209/584 |

FOREIGN PATENT DOCUMENTS

| | | |
|---|---|---|
| WO | 9824564 | 6/1998 |

* cited by examiner

MIXED PRODUCT DELIVERY POINT SEQUENCER AND METHOD OF USE

FIELD OF THE INVENTION

The invention generally relates to a sequencing device and, more particularly, to a delivery point sequencing device for sequencing streams of different types of products such as letters and flats into a continuous sequenced stream and a method of use.

BACKGROUND DESCRIPTION

The sorting of mail is a very complex, time-consuming task. In general, the sorting of mail is processed though many stages, including back end processes, which sort or sequence the mail in delivery order sequence for each carrier route. These processes can either be manual or automated, depending on the mail sorting facility, the type of mail to be sorted such as packages, flats, letters and the like. A host of other factors may also contribute to the automation of the mail sorting, from budgetary concerns to modernization initiatives to access to appropriate technologies to a host of other factors.

Most modern facilities have taken major steps toward automation by the implementation of a number of technologies. These technologies include, amongst others, letter sorters, parcel sorters, advanced tray conveyors, flat sorters and the like. As a result of these developments, postal facilities have become quite automated over the years, considerably reducing overhead costs.

In one type of automated process, a two pass automated process may be used for sequencing mail pieces in delivery order for each carrier route. Using mail pieces as an illustrative example, the mail pieces are first provided in random order. In the first pass, the mail pieces are separated into groups by delivery point (i.e., specific sets of carrier routes), but in no specific order or sequence. In further passes, the groups of the mail pieces are sorted into a delivery sequence order.

By way of one specific example, in a first pass, directions are assigned to a set of delivery points. Taking four directions with 16 delivery points as an example, a first pass may assign the following directions to each delivery point as follows:

| | | | | |
|---|---|---|---|---|
| Direction #1 | 1 | 5 | 9 | 13 |
| Direction #2 | 2 | 6 | 10 | 14 |
| Direction #3 | 3 | 7 | 11 | 15 |
| Direction #4 | 4 | 8 | 12 | 16 |

That is, in the $1^{st}$ row (direction 1) there are delivery points for 1, 5, 9 and 13. In the $2^{nd}$ row, (direction 2) there are delivery points for 2, 6, 10 and 14. In the $3^{rd}$ row (direction 3), there are delivery points for 3, 7, 11 and 15. Lastly, in the $4^{th}$ row (direction 4), there are delivery points for 4, 8, 12 and 16.

However, these sets of delivery points are only grouped according to carrier route, but are not in a delivery sequence, i.e., in any particular order or sequence within that group. To properly sequence the mail pieces in delivery order, a second pass or sorting process must be performed on the mail pieces. In doing so, it is possible to reassign the delivery points to the directions in the following manner, for example,

| | | | | |
|---|---|---|---|---|
| Direction #1 | 1 | 2 | 3 | 4 |
| Direction #2 | 5 | 6 | 7 | 8 |

-continued

| | | | | |
|---|---|---|---|---|
| Direction #3 | 9 | 10 | 11 | 12 |
| Direction #4 | 13 | 14 | 15 | 16 |

Now, after second pass, each direction includes a sequenced set of delivery points. That is, direction 1 includes a sequenced order of delivery points for 1, 2, 3 and 4. Direction 2 includes a sequenced order of delivery points for 5, 6, 7, and 8. Direction 3 includes a sequenced order of delivery points for 9, 10, 11 and 12. Lastly, direction 4 includes a sequenced order of delivery points for 13, 14, 15 and 16.

To complicate matters in the sorting processes, currently 100% of the flat mail is manually sorted to delivery point sequence, which is a very time consuming and labor-intensive process. This means that it is also necessary to manually sequence the letters and flats, when intermixing these products. In addition, current processing operations cannot efficiently sort late arriving mail. At best, the late arriving mail is received at the regional level and receives only a quick automatic sort to zone level. As such, late-arriving mail can only be sorted to the destination post office, where it is manually sorted to the carrier level. This manual sorting takes 2 to 3 hours each delivery day per carrier, multiplied by 300,000 carriers nationwide.

The invention is directed to overcoming one or more of the problems as set forth above.

SUMMARY OF THE INVENTION

In a first aspect of the invention, a device for sequencing disparate products, comprises a first feeder mechanism which feeds a stream of a first product type in a pre-sequenced order and second feeder mechanism which feeds a separation item before or after each packet of the packets formed by the packet former. A packet former packetizes the first product type into packets having common product information. A third feeder mechanism feeds a stream of second product type though a sequencing process. A reading device reads product information of the first product type and the second product type, and a controller is coupled to at least the first, second and third feeder and the reading device. A pausing device, under control of the controller, intermittently pauses at least one of the packets formed by the packet former and the second stream of the second product type, during second pass, to intermix and sequence the packets and the second stream of the second product type having the common product information into a merged stream of first and second product type.

In another aspect of the invention, a sequencing method comprises providing a first type of product in a pre-sequenced order and packetizing the first type of product into packets based on common information. A separation item is placed at a beginning or end point of each of the packets. The second type of product is provided through a first pass sort into delivery groups. During sequencing of the second type of product, the process intermixes the packets of the first type of product associated with a common group of the second type of product into a stream to form a merged sequential order of the first type of product and the second type of product with a separation item between groupings.

In yet another sequencing method, the first type of product is provided in a sequenced order and a second type of product is passed through a two pass sort to sequence the second type of product. The first type of product is intermixed with the second type of product during a second pass sort of the second type of product such that the second type of product forms a merged sequential stream, in a delivery point sequence, with the first type of product. A separation item is placed between different groups of the merged sequential stream prior to the intermixing step in order to form defacto packages.

DETAILED DESCRIPTION OF EMBODIMENTS OF THE INVENTION

A working goal of the United States Postal Service (USPS) is to provide a system and method capable of sequencing flats in the same manner as letters, and merging the sequenced flats with sequenced letters and forming a cohesive group of product. If, for example, the letters and flats can each be grouped for each delivery point, the mail carrier will have an easier time to differentiate each delivery point.

The invention is capable of providing the mail carrier with only one automated sequenced mail bundle, to reduce on-street effort. In the invention, a sequencing device and method is provided which is capable of sequencing different types of products such as, for example, flats and other mail items (i.e., letters), into a merged, sequenced stream of intermixed product for future delivery or warehousing or the like. The system and method can place the mail in "defacto" groups, for ease of delivery, and can further accommodate and sort saturation mail with the mail pieces and flats.

By way of non-illustrative example, the invention is capable of:

- adding a separator card for definitive address separation,
- allowing multiple letter mail batches to be processed in parallel during second flats pass to pick up any late arriving letter mail, and
- providing the ability to input, during the second flat pass, difficult to process, easily damaged pre-sequenced mail (letters or flats), so as to expose this mail type to only one pass through the machine.

The invention also significantly reduces processing times for sequencing and merging both flats and letter pieces or other disparate products in delivery point sequence using, in embodiments, parallel processing. Other applications such as warehousing and storage applications are also contemplated for use with the invention.

System of the Invention

Figure 1:
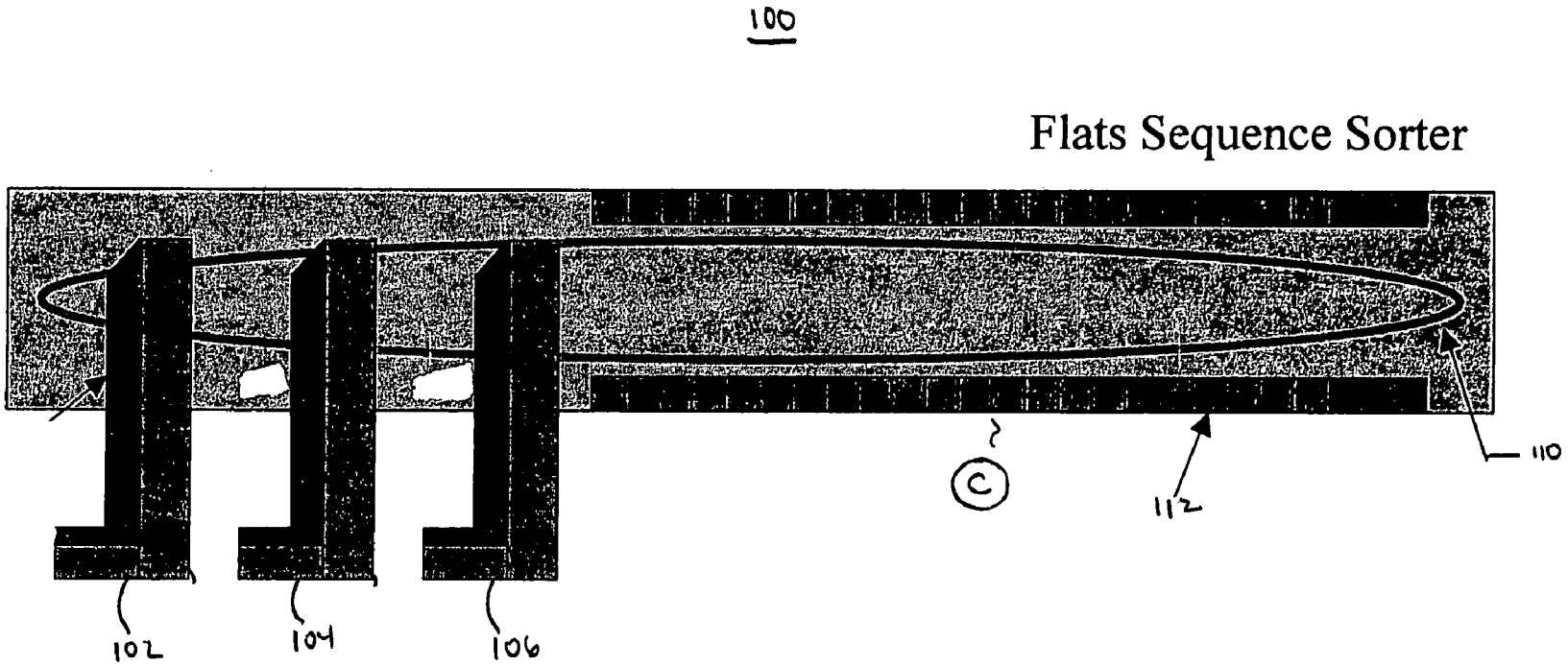
FIG. 1 shows a schematic diagram of the sequencing device of the invention.

Referring now to FIG. 1, a schematic diagram of the sequencing device of the invention is shown. In the embodiment of FIG. 1, the sequencing device is generally depicted as reference numeral 100 and includes three feeding devices 102, 104 and 106. In embodiments, the feeding device 102 is a letter feeder with a feed rate capacity of approximately 40,000 letters per hour and the feeding device 104 is a flats feeder with a feed rate capacity of approximately 10,000 flats per hour. The feeding device 106 can be a special purpose feeder such as, for example, a saturation mail feeder or separator feeder. More than one letter and flat feeding device may also be implemented with the system and method of the invention.

By providing a separator feeder, as an option according to work plan, separator cards can be injected into designated letter packets, either as the first or last mail piece. This will result in definitive address separation, e.g., defacto packages. By way of one illustrative example, the induction of a separator card can be performed based on the letter/flat content for each delivery point, for every delivery point or for no delivery point.

By providing a saturation feeder to feed pre-sequenced difficult-to-feed mail pieces, easily damaged saturation mail that could not survive additional passes through the sorting machine, can be fed into the system. In one embodiment, these saturation mail pieces are pre-sequenced in the same sequence as the mail letters when input during the flats second pass. Induction of these mail pieces can take place following sortation of each flats layer in the output bins, before the letter packet(s), or can be sorted following sortation of the letter packets for each layer. The saturation mail can thus be merged with letters and other flats during second pass sequence sort, thus saving significant time and wear and tear on the flat mail. This option is available according to whether a separator card or the difficult-to-process mail piece is to be used as an address separation identifier. The result is flats, letters and the difficult-to-process mail piece can be grouped for each sequential delivery point, with each delivery point separation identified by either a separator card or the difficult to process mail piece.

Those of ordinary skill in the art should recognize that other types of feeders and feeding capacity rates and combinations thereof may be used with the invention, and that the feeding devices 102, 104 and 106 are provided for showing an exemplary description of the invention. Also, two or more letter feeders may also be used with the invention to induct late arriving mail into the sorted flats and sequenced mail during second pass operations. This will allow the late arriving mail to be sequenced with the flats and other mail. The two or more letter feeders may also be used to increase throughput of sequenced mail pieces. Also, by way of another non-limiting example, the system of the invention can include both the saturation mail feeder and separator feeder.

In embodiments, the feeders 102, 104 and 106 may have associated pause devices as well as inserters, either part of the feeders or coupled thereto. The pause devices are used to pause the stream of flats or other types of products while other products are being inducted from the other feeders. The inserters insert product into the sequenced or non-sequenced stream of product. A conventional type transporting system 110 is provided for transporting both flats and letters or other products from the feeders 102, 104 and 106 to output bins 112.

In the embodiment shown in FIG. 1, the letters and flats will be inducted from the respective feeders 102, 104 and transported to any number of the output bins 112 via the transporting system 110. In further embodiments, a grouping of output bins 112 may be designated for any number of respective carrier routes or groupings of mail pieces for future delivery order. The output bins 112 and the transporting system 110 may equally be used for other products, for future warehousing, storage and the like. The system may be controlled by controller "C" to implement the controls and method of the invention, as discussed below.

Figure 2:
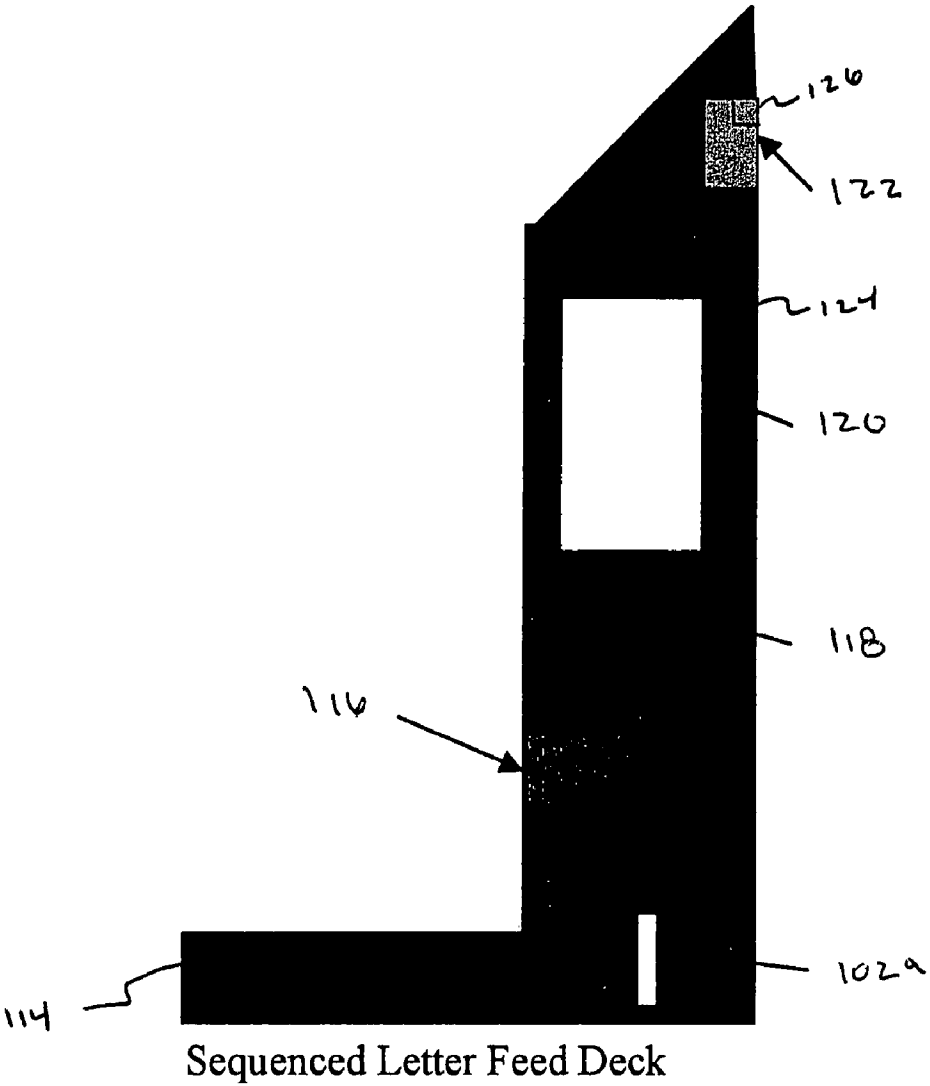
FIG. 2 shows a schematic diagram of a feeder device used with the invention.

FIG. 2 is a schematic diagram of one of the feeders used in the implementation of the invention. For discussion, the feeder 102 will be discussed and assumed to be a letter feeder, but this feeder may equally be a different type of feeder. The feeder 102 includes a feed deck 114 and has an associated camera, optical reading device, bar code reader or other type of reading device 116 coupled thereto. The feed deck 114 may be of different lengths, based on the amount of mail processed on each feeder. In embodiments, the reading type device 116 may be mounted to the feeder, but may be located near or proximate to the feeder. The reading device 116 is designed to read the delivery point or other pertinent product information provided on each product, as should be well understood by those of skill in the art. This information is then provided to the controller "C" which, in turn, resolves this information for sequencing of the products using any well-known sequencing algorithm.

In aspects of the invention, the products such as letters, after second pass, are provided in a pre-sequenced order from either highest order to lowest order or vice versa. The feed deck 114 transports the pre-sequenced product such as letters to a transport portion 118 of the feeder. At this stage, in aspects of the invention, the product may be packetized using a packet former 120, which may be opposing friction belts. The packet former 120 may collect the letters or other mail pieces or other product having a same destination information (delivery address) or same or common product information into a packet, up to a maximum total packet thickness, e.g., the packet former 120 groups letters with identical delivery point addresses into packets, with the last piece of the last packet for each delivery point being (by option) a separator card.

Packets may be made of one or more letters addressed to the same delivery point, and may be fed from one or more letter feeders, operating in sequence, delivery point by delivery point. In one embodiment, the maximum packet thickness is the same thickness as the maximum thickness flat, with multiple packets being formed to the same delivery point, if necessary; however, the maximum packet thickness may be based on the maximum thickness that can be transported within the transporting system 110. Each packet is then processed to its delivery point as one flat, significantly increasing overall system throughput, i.e., letters can be input at typical letter speeds of 40,000 pieces per hour, while the flats are input at 10,000 pieces per hour. Given four letters for each package, all letter and flat feeders can operate at maximum throughput. The packet is then transported to a packet inserter 122, which inducts the packet onto the transporting system 110. In one embodiment, the letter packet is inducted as one flat into the transport 110 using the same dedicated position in the transport as the accompanying flat (see illustrative examples below).

In embodiments, the feeder also includes a pause device 124 downstream of the reading device 116. The pause device pauses or stops the product based upon the information associated with the bar code or other information such as area code and the like (i.e., delivery point address) of each individual product or packet. In embodiments, the pause device 124 is capable of pausing:

(i) the stream of product starting with the product that has different destination information than that of the product being formed into the packets, or (ii) the formed packet until it is the appropriate time to induct the packet in the mail or product stream so that the packet and the product inducted from the other feeders can be in sequential order.

In one embodiment, the letter feeder 102 has an associated letter packet queue 126, which may be coupled to the letter feeder 102. The letter packet queue 126 may also be associated with the separator feeder 106, and used alone or in conjunction with the pause device 124. The letter packet queue 126 is designed to queue the sequenced letters until the appropriate injection time into the stream of the flats.

Figure 3:
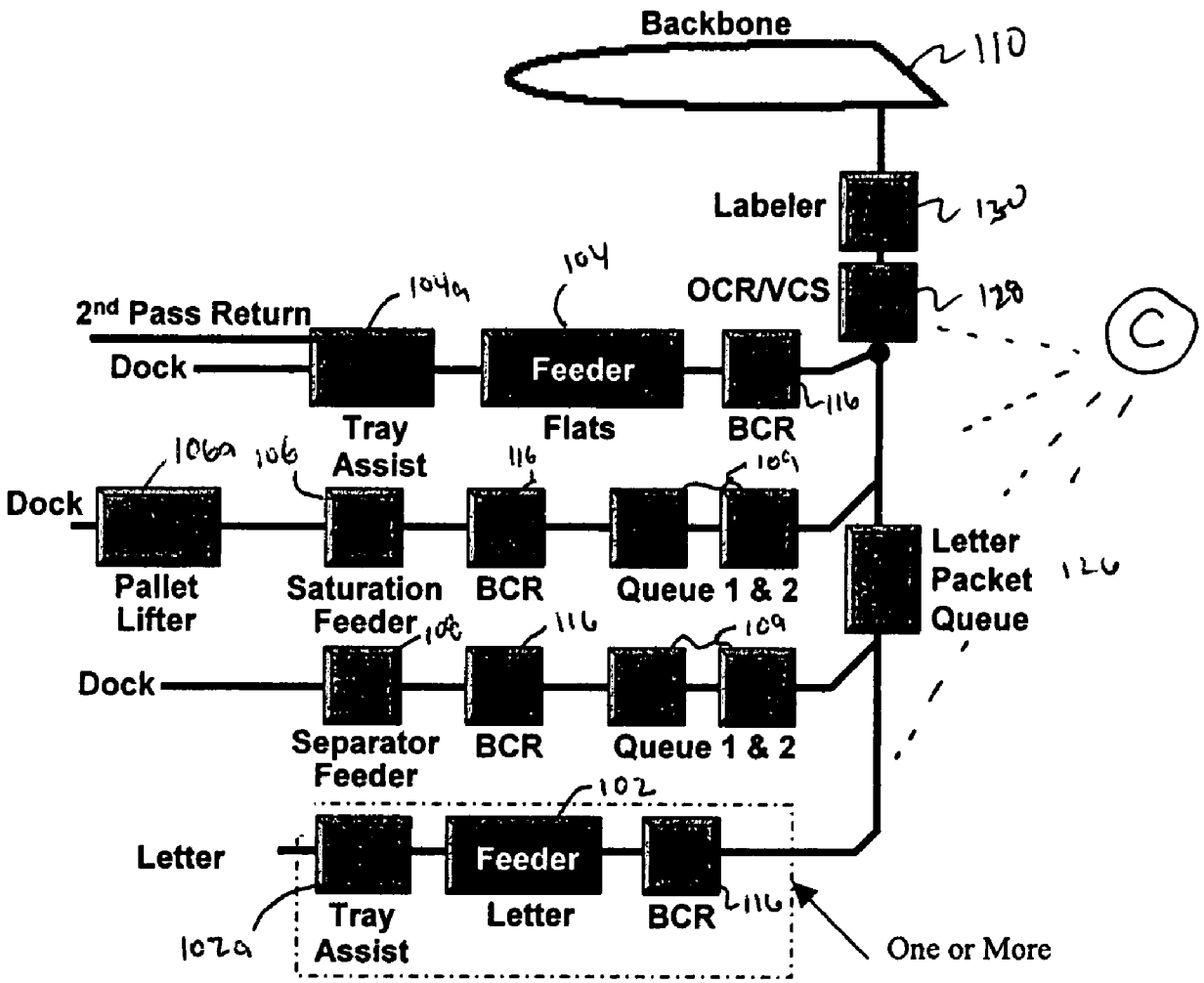
FIG. 3 shows an implementation of an embodiment of the system of the invention.

FIG. 3 represents an illustrative implementation of the system of the invention. FIG. 3 shows four feeders 102, 104, 106 and 108, which represent, respectively, a letter feeder, a flat feeder, a saturation feeder and a separator feeder. As discussed, more than one letter feeder may be provided with the system in order to add the ability to process two (or more) streams of pre-sequenced letters or late arriving mail, covering the same address set, to be interleaved with the flats during the second sequencing pass. This enables the ability to pre-sequence an early batch of letter mail, when significant volume is available, and then pre-sequence a second batch of remaining late arriving letter mail, and combine both during the second pass sequencing event for the flats.

The respective feeders 102, 104, 106 and 108 each have a camera, optical reading device, bar code reader or other type of reading device 116 coupled thereto. A pallet lifter 106 may be used to lift pallets to the saturation feeder 106, and a tray assist 102*a* and 104*a* may be used to hold trays during the loading and/or feeding process of the letter feeder 102 and flat feeder 104.

If required, the saturation feeder 106 and separation feeder 108 may have associated queues 109, for queuing the saturation and/or separator cards until the appropriate injection time into the stream of the flats and/or letter. The saturation feeder 106 provides the added functionality of adding the ability to interleave a stream of pre-sequenced flats (or letters), typically very difficult-to-handle, easily damaged flats, during the second pass of flats, so that this mail stream is subjected to only one pass through the machine, versus the normal two passes.

In embodiments, the separator 108 is a card feeder, which feeds a separator card into the final letter packet formed for each delivery point. The separator card may be a reusable plastic card, a special easy-to-identify deliverable mail piece, or a colored piece of paper that may be discarded by the mail carrier or mail recipient. Adding a separator card to the letters for each delivery point as they are interleaved with the flats, provides a definitive break identifier between addresses. This results in a defacto package, thus making mail delivery more efficient.

FIG. 3 also shows an OCR/VCS 128 and a labeler 130 downstream from the feeder 104. The OCR/VCS 128 reads and/or reconciles information from the flats and/or letters which, in turn, are provided to the controller "C". The controller then uses this information to coordinate the induction of the different flats and/or packaged letters onto the transport 110, in order to sequence the intermixed mail. The labeler 130 may provide labels comprising certain address information, or other indicia, onto the flats or packages, for later identification or other purposes such as mailing order or the like.

Method of Sequencing Product Using the System of the Invention

The invention will be described with the implementation of letters and flats, but it should be understood that the letters and flats might be any different type of products such as a first type of product and a second type of product. The method of the invention may be used for a single carrier route at a time, multiple routes at once or for warehousing or other sequencing needs of disparate products. In the aspects of the invention, the controller "C" provides a control for merging pre-sequenced letters into a sequenced stream of flats based on a two-pass sort system. The controller "C" may also be implemented and configured to induct and sequence late arriving mail with the pre-sequenced mail, in addition to the flats, saturation mail and/or separator cards. The controller "C" will resolve the identification information of all types of mail pieces, coordinate the formation of packages of the sequenced mail, as well as the movements of the mail types through the system by control of the inserters, feeders, transport and the like, similar to that for a single mail type system. The same underlying concept can also be implemented in other known sort processing systems, and should thus not be limited to only a two pass sort system. The two pass sort is provided as one aspect of the invention to more readily describe the advantages of the invention.

Figure 4:
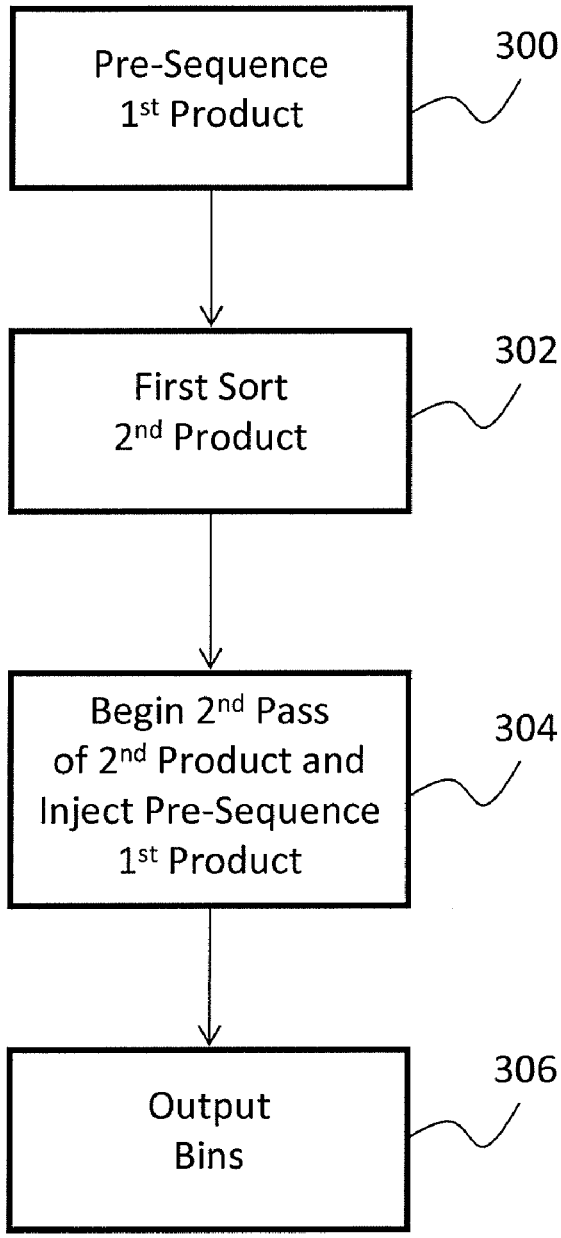
FIG. 4 is a flow diagram showing steps implementing the method of the invention.
Figure 5:
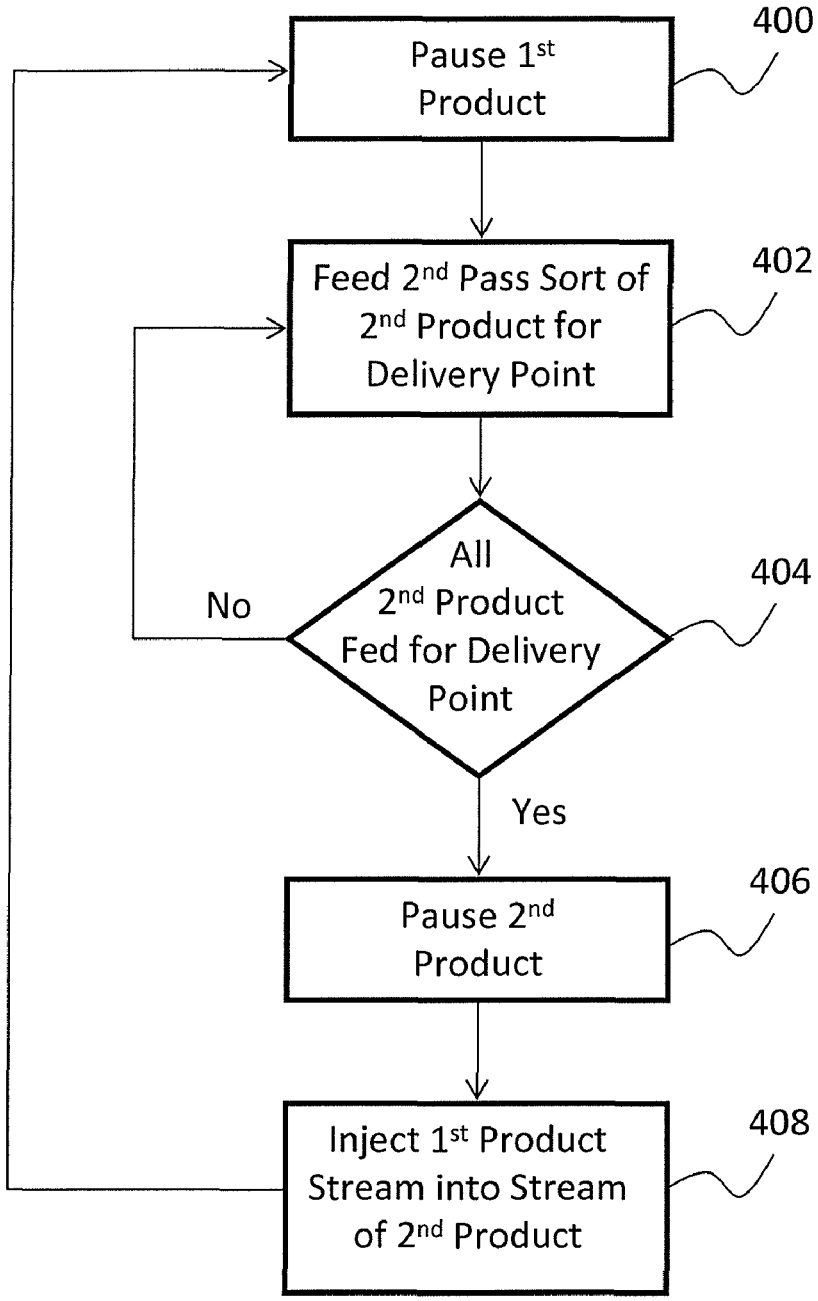
FIG. 5 is a flow diagram implementing steps of FIG. 4.

Reference is now made to FIGS. 4 and 5 showing the steps of implementation of the invention. FIGS. 4 and 5 are representative flow diagrams and the steps thereof may be implemented on computer program code in combination with the appropriate hardware. This computer program code may be stored on storage media such as a diskette, hard disk, CD-ROM, DVD-ROM or tape, as well as a memory storage device or collection of memory storage devices such as read-only memory (ROM) or random access memory (RAM). FIGS. 4 and 5 may equally represent a high-level block diagram of the system of the invention, implementing the steps thereof.

In particular, in step 300, the letters are pre-sorted into a sequential order for delivery using, for example, any well-known two-pass sort algorithm. In step 302, the flats are first pass sorted using any known sort algorithm. During the second pass of the flats, the pre-sequenced letters are inducted into the stream of the flats (step 304), with either a separator card or saturation mailing insert dividing groups, e.g., each delivery point address. In the case of late arriving mail, such late arriving mail may first be sorted to a group (not sequenced) and then inducted into the same stream of flats for sequencing, during second pass operations, in a manner similar to that of the flat mail. The output is a sequentially merged group of letters and flats for each delivery point in a defacto package, using only two passes for the flats, thus reducing or minimizing damage to the flats.

More specifically referring to step 300, the letters may be run through the sorting device twice, i.e., the two-pass method. In the first pass, the letters are sorted such that the first bin includes, in a mixed or non-ordered manner, the first delivery point for each piece of mail or product for the respective bin that will be filled during the second pass and so on. In aspects of the invention, the first pass may group the letters in each bin by delivery point sequence number for second pass and additionally group the mail or product into the first pass bins by specific sets of carrier routes. The grouping of the first pass bins by groups of carrier routes allows each feeder, on second pass, to process its own set of carrier routes, allowing all feeders to operate in parallel during second pass. This increases the second pass throughput. This same process, for first pass, may also be utilized for the flats.

In one embodiment, when letters from the first bin is processed during second pass, it is distributed, as addressed, to the appropriate second pass bin as the first set of letters entering each bin, in sequence. Similarly, when letters from the second first pass bin is processed during second pass, it is distributed, as addressed, to the appropriate second pass bin as the second set of letters entering each bin, and so on. In this way, following second pass, the $1^{st}$ bin, for example, will include delivery points 1 to X in sequence. Similarly, following second pass, the $2^{nd}$ bin will include delivery points X+1 to Y in sequence, etc. This same process will be used for the flat sorting, to more efficiently intermix the mail pieces during sequencing operations.

After fully sequencing the letters and first pass sorting the flats, the methodology of the invention will begin to process the flats in second pass in step 304. That is, the pre-sequenced packetized letters are intermixed into the stream of flats during the second pass process of the flats resulting in, after the second pass sort of the flats, a merged stream of letters and flats, each grouped for each address in a carrier group in sequence. Each mail or product grouping follows one another, in sequence. Prior to inserting the packetized letters into the stream of the flats, a separator card or saturation mailing can be injected after the last piece of mail (letter) for the particular delivery address. This will form a defacto package after sequencing is finished.

Thus, during second pass, the flat mail first sorted, as a group, is the flat mail going to the first assigned delivery point for each second pass bin location. The second group of flat mail is the flat mail going to the second assigned delivery point for each second pass bin location. All mail, e.g., letters and flats (or other product) going to each group of delivery points (first delivery point, second, etc.) are all intermixed at the start of second pass, but are all grouped together, as shown in the example below. Each mail grouping follows one another, in sequence.

During second pass, it is possible to also use a second (or more) letter feeder that has the capability to process a second (or more) stream of letters that have been identically pre-sequenced to the same set of addresses. To accomplish this, the same sort algorithm is performed on the second letter stream as the first, but each address group of letters from the second stream are added to the letters being held in the packet formed for the same address from the first stream. In this manner, the two letter streams are combined, by delivery point, in the same packet(s) before induction into the transport backbone of the sequencing machine. Also, in embodiments, any late arriving mail may be injected into the stream of flats using the second or more letter feeder, in the same delivery point grouping as that of the flats.

The sequenced and merged flats and letters are then provided into the output bins in step 306. The letter feeder, the flat feeder and other special purpose feeders, as now can be recognized by those of skill in the art, work in conjunction with one another (i.e., pausing and starting) to inject the letters and flats into a sequential, merged stream.

FIG. 5 shows further steps implementing the method of the invention. The steps of FIG. 5 may be used with the example provided above, or other illustrative examples. In particular, in step 400, the stream of letters or packets of letters (i.e., $1^{st}$ type of product) are paused on the feeder. In step 402, the flats ($2^{nd}$ type of product) for a set of delivery points are fed through the system for a second pass sorting. In step 404, a determination is made as to whether all of the flats for the set of delivery point are completely fed through the system. If not, step 402 continues.

If step 404 is affirmative, the flat induction is paused in step 406. The pre-sequenced stream of letters or packets for each delivery point is then fed to the previous group of flat delivery points in step 408, with a separator card, saturation mail or both. Pausing flat mail induction at this point, allows all letter mail belonging to the same group of delivery points just processed to form a group with the second pass sorted flats for each delivery point. This process continues until the entire stream of product is sequenced. The result is flats for each delivery point followed by letters for each delivery point, in sequence in the manner they will be delivered, with a separator card or saturation mail or both forming defacto packages for each delivery point.

Example

The following example is based on using four, second pass bins assigned to a specific flats feeder. In the example, in the first pass, the first to fourth first pass bins receive flats in any mix for the following delivery points:

| BIN | Delivery Point | Delivery Point | Delivery Point | Delivery Point |
|---|---|---|---|---|
| 1st first-pass bin | 1 | 5 | 9 | 13 |
| 2nd first-pass bin | 2 | 6 | 10 | 14 |
| 3rd first-pass bin | 3 | 7 | 11 | 15 |
| 4th first-pass bin | 4 | 8 | 12 | 16 |

In one embodiment, the first pass algorithm not only groups the flats in each bin by delivery point sequence number for second pass but also groups the mail into the first pass bins by specific sets of carrier routes. Grouping the first pass bins by groups of carrier routes means that on second pass, each feeder can process its own set of carrier routes, allowing all feeders to operate in parallel during second pass, greatly increasing the second pass throughput of the sorting machine As part of the methodology of the invention, the sort yield above is used for the second pass. In this example, the two-pass pre-sequenced letter mail stream that is to be merged into the flat mail should be sequenced in the same delivery point groups, by particular delivery point, as the first pass flats as they start second pass. Although the letter mail does not have to be in the same exact order for each group, an illustrative example of the letter mail sort is provided below.

| Delivery Point | Delivery Point | Delivery Point | Delivery Point |
|---|---|---|---|
| 1 | 5 | 9 | 13 |
| 2 | 6 | 10 | 14 |
| 3 | 7 | 11 | 15 |
| 4 | 8 | 1216 | |

As the flats are processed into the flat feeder during second pass, the first flat mail piece encountered in each new grouping is identifiable since the delivery points are pre-assigned for each grouping. As the flats are fed onto (or prior to the feeding) the transport for second pass, a separator card or saturation mail is injected at the end (or beginning) of the grouped letter mail, which may be used to form of a defacto package.

After sorting all mail pieces assigned to the 1, 5, 9 and 13 delivery points, the first mail piece from the second group is encountered, which could be destined for either the 2, 6, 10, or 14 delivery point. Upon encountering that first flat piece in each new grouping, it is assured that all flat mail pieces in the previous grouping have been inducted and are at least on the way to second pass sort. Pausing flat mail induction at this point, all letter mail belonging to the same group of delivery points just processed, e.g., packetized with a separator card or saturation mail, can now be inducted, effecting a grouping of flats, then a grouping of letters, for each delivery point.

After sorting flat mail of the grouping 1, 5, 9 and 13 to second pass bins 1, 2, 3, and 4, respectively, and encountering the first flat belonging to the group 2, 5, 10, 14, the mail stream is paused and the letter group containing delivery groups 1, 5, 9 and 13 is sorted. (As a result of two pass letter sequencing, all letters within this group of four delivery points will be further grouped by delivery point: all delivery point 1 will be together, as will be letters for delivery points 5, 9 and 13.)

As the letter groups are fed, they are formed into one or more packets for each delivery point, where the total thickness of each packet is able to approach that of the maximum thickness flat. The packet former groups the letters together by delivery point to maximum flat thickness, adding as a last piece the separator, if this option is activated. When the flat sequencer encounters a new set of delivery points, flat induction is paused, and the feeder feeding the difficult-to-process pieces is started, all controlled by the controller "C". These mail pieces are sorted to the previous group of delivery points.

Following processing of the difficult-to-process pieces to the previous group of addresses, the letter packets are fed for the previous group of addresses. The separator card, as the last letter piece, may serve as a delivery point separator. The result is that the system groups the letters into packets, to take advantage of the high throughput of the letter feeder, while at the same time using the slower flat sorter transport to transport the flat pieces as well as the difficult-to-process pieces. Also, merging the letters and flats as groups for each delivery point in delivery point sequence provides a defacto separation of each delivery point, making it far easier for the on-street delivery person to separate each delivery point, thus saving considerable on-street time and improving delivery efficiency, while at the same time saving the cost of packaging material.

Thus, add-on features provide additional cost benefit such as, for example,

- separator cards will reduce further on-street carrier effort,
- the ability to incorporate late arrival mail in the sequenced package reduces mail carrier in-office and on-street manual-sort efforts,
- the ability to incorporate hard-to-process mail in the sequenced package further reduces mail carrier in-office and on-street manual sort efforts, and
- the ability to limit that times that flat mail is processed through a flat feeder.

While the invention has been described in terms of preferred embodiments, those skilled in the art will recognize that the invention can be practiced with modification within the spirit and scope of the appended claims.

It is claimed:

1. A device for sequencing disparate products, comprising:

a first feeder mechanism feeding a stream of a first product type in a pre-sequenced order;

a packet former which packetizes the first product type into packets having common product information;

a second feeder mechanism feeding a separation item before or after each packet of the packets formed by the packet former;

a third feeder mechanism feeding a stream of second product type though a sequencing process;

a reading device reading product information of the first product type and the second product type;

a controller coupled to at least the first, second and third feeder and the reading device; and a pausing device, which under control of the controller, intermittently pauses at least one of the packets formed by the packet former and the second stream of the second product type, during second pass, to intermix and sequence the packets and the second stream of the second product type having the common product information into a merged stream of first and second product type.

2. The device of claim 1, further comprising a transport system transporting the merged stream of first and second product type to output bins, into a sequenced order.

3. The device of claim 1, wherein the controller coordinates movements of the packets and the second stream of the second product type into the merged stream of the first and second product type with the separation item to form defacto packages in output bins, in a sequenced order.

4. The device of claim 1, wherein the first type of product is mail pieces and the second type of product is flats mail.

5. The device of claim 1, wherein the separation item is at least one of saturation mail and a separator card.

6. The device of claim 1, wherein the common product information is common address information.

7. The device of claim 1, further comprising a transport system which transports, under control of the controller, the second product type, incrementally fed from the at least third feeder in the first sort order to designated output bins while transporting at least one packet of the pre-sequenced first type of product to the designated output bins to form sequenced first and second product type during second pass sort of the second product type.

8. The device of claim 7, wherein the pausing device pauses the packets of the first product type until after a designated last product of the second product type is provided on the transporting system during the second pass sort.

9. The device of claim 1, wherein:

the first product type having a lower order sequence number is processed prior to the first product type having a higher order sequence number; and the pausing device pauses the first product type with the higher order sequence number until the first product type and the second product type with the same common product information have been processed into the merged stream during the second pass sort of the sequencing process of the second product type.

10. The device of claim 1, further comprising a packet queue for queuing the packets prior to induction onto a transporting system.

11. The device of claim 1, further comprising a fourth feeder mechanism which feeds sorted late arriving first type of product into the stream of the second product type during a sequencing process to sequence the sorted late arriving first product type with the packets of the first product type and the second product type into delivery sequence.

12. A sequencing method, comprising:

providing a first type of product in a pre-sequenced order;

packetizing the first type of product into packets based on common information;

placing a separation item at a beginning or end point of each of the packets;

sorting a second type of product through a first pass sort into delivery groups; and during sequencing of the second type of product, intermixing the packets of the first type of product associated with a common group of the second type of product into a stream to form a merged sequential order of the first type of product and the second type of product with a separation item between groupings.

13. The sequencing method of claim 12, further comprising pausing the packets of the first type of product until after another group of the second type of product has passed thereby.

14. The sequencing method of claim 12, wherein the intermixing step comprises providing the pre-sequenced first type of product into the stream of the second type of product during a second pass sort of the second type of product.

15. The sequencing method of claim 12, further comprising reading product information from the pre-sequenced first type of product and the second type of product during a second pass sort of the second type of product and prior to the intermixing step.

16. The sequencing method of claim 12, wherein the second type of product is fed through a feeder only two times in order to sequence the second type of product with the first type of product.

17. The sequencing method of claim 12, further comprising inducting late arriving first type of product into the stream during the intermixing step to sequence the late arriving first type of product, the packets of the first type of product and the second type of product.

18. A sequencing method, comprising:

providing a first type of product in a sequenced order;

passing a second type of product through a two pass sort to sequence the second type of product; and intermixing the first type of product in the sequenced order with the second type of product during a second pass sort of the second type of product such that the second type of product forms a merged sequential stream, in a delivery point sequence, with the first type of product;

placing a separation item between different groups of the merged sequential stream prior to the intermixing step in order to form defacto packages.

19. The sequencing method of claim 18, wherein the first type of product is formed into packets of about a same thickness as that of a single second type of product prior to the intermixing step.

20. The sequencing method of claim 18, further comprising operating each feeder for the first product type and the second product type in parallel such that on a second pass sort each feeder processes its own set of carrier routes in a delivery sequence with the first type of product and the second type of product.

* * * * *